United States Patent [19]

McClocklin

[11] 4,105,369

[45] Aug. 8, 1978

[54] TWO-STAGE PUMP

[75] Inventor: Samuel B. McClocklin, Owatonna, Minn.

[73] Assignee: Owatonna Tool Company, Owatonna, Minn.

[21] Appl. No.: 811,560

[22] Filed: Jun. 30, 1977

[51] Int. Cl.[2] ..... F04B 23/12

[52] U.S. Cl. ..... 417/206; 417/269

[58] Field of Search ..... 417/204, 205, 206, 244, 417/269

[56] References Cited

U.S. PATENT DOCUMENTS

| | | | |
|---|---|---|---|
| 2,495,685 | 1/1950 | Beaman et al. | 417/206 |
| 2,604,047 | 7/1952 | Beaman et al. | 417/206 |
| 3,053,186 | 9/1962 | Gondek | 417/252 |
| 3,380,392 | 4/1968 | Boers | 417/206 X |
| 3,614,267 | 10/1971 | Schultze | 417/206 |
| 3,992,131 | 11/1976 | Masterman et al. | 417/206 |

*Primary Examiner*—Carlton R. Croyle
*Assistant Examiner*—Richard E. Gluck
*Attorney, Agent, or Firm*—Wegner, Stellman, McCord, Wiles & Wood

[57] ABSTRACT

A two-stage pump having a low and high pressure stages having a casing with a pair of pumps positioned therein, with one pump being a low pressure stage unit and the other pump being a high pressure stage unit. Each of the pumps has a fluid inlet and a fluid outlet with the outlet of the low stage pump being in fluid flow relation with an outlet port from the casing and also the fluid inlet of the high stage pump. The low stage pump is supplied with fluid through internal flow passages in the casing and associated structure including a flow passage through a rotatable element of the high stage pump.

10 Claims, 4 Drawing Figures

12
20
38
39
40
11
31
33
32
35
37
36
30
80
2.
2.
45
46
86
25
15
85
81
72
71
75
3.
3.
16
65
76
70
77
51
52
73
78
66
53
50
54
58
54
17
61
60
90
55
57
56
19
18
22
21
23

45
35
46
36
30

TWO-STAGE PUMP

BACKGROUND OF THE INVENTION

This invention pertains to a two-stage pump. Drive means for the high and low pressure stage pumps is mounted at one end of a casing, with a fluid intake at the other end thereof and with flow passage means formed through at least one part of the high stage pump for directing fluid from a reservoir to an inlet of the low stage pump.

The assignee of this application has U.S. Pat. Nos. 3,053,186 and 3,992,131, disclosing two-stage pumps with at least one of these patents showing the combination of a low pressure, multi-lobe pump and a high pressure axial piston pump. Additionally, Beaman et al U.S. Pat. Nos. 2,495,685 and 2,604,047 show an axial piston pump shaft having a central passage with fluid flow therethrough but without this being a supply passage for a first stage pump. This prior art does not have a pair of pumps, each with a rotatable element mounted in coaxial relation for drive by drive means and with a simple fluid flow path for fluid flow through the unit including supply of fluid to the low pressure stage pump through components of the high pressure stage pump.

SUMMARY OF THE INVENTION

A primary feature of the invention disclosed herein is to provide a multi-stage pump having a low pressure multi-lobe pump with a rotatable inner member in alignment with a rotatable element of a high pressure pump interposed between the low pressure stage pump and a reservoir. The supply of fluid to the fluid inlet of the low pressure stage pump is by means including a flow passage through the high pressure stage pump without the use of auxiliary structure forming flow passage means whereby the multi-stage pump is of a simpler and more compact construction.

An object of the invention is to provide a multistage pump wherein the multi-stage pump has high and low pressure stages, each defined by a pump positioned in the casing, and each having a rotatable pump element in coaxial relation, one to the other, drive shaft means for rotating both of said pump elements, each of said pumps having a fluid inlet and a fluid outlet, with the high pressure stage pump having a flow passage through the rotatable element thereof for supply of fluid to the fluid inlet of the low pressure stage pump from a source of fluid.

Another object of the invention is to provide a two-stage pump having a casing, a pair of pumps in the casing in coaxial relation including a multi-lobe pump defining a low pressure stage having a rotatable inner member and a pump defining a high pressure stage having a barrel with reciprocable pumping elements and a control member for controlling movement of said pumping elements, one of said barrel and control member being rotatable coaxially with the inner member of the multi-lobe pump, means including a motor at one end of the casing and drive shaft elements for imparting rotation to said pumps, a fluid inlet at an end of the casing opposite said motor for communicating with a reservoir for supply of fluid to the low pressure stage pump, and flow passage means from said fluid inlet at the end of the casing to the fluid inlet of said multi-lobe pump including a flow passage through at least one of the barrel and control member of the piston pump.

DESCRIPTION OF THE PREFERRED EMBODIMENT

Figures 1, 4:
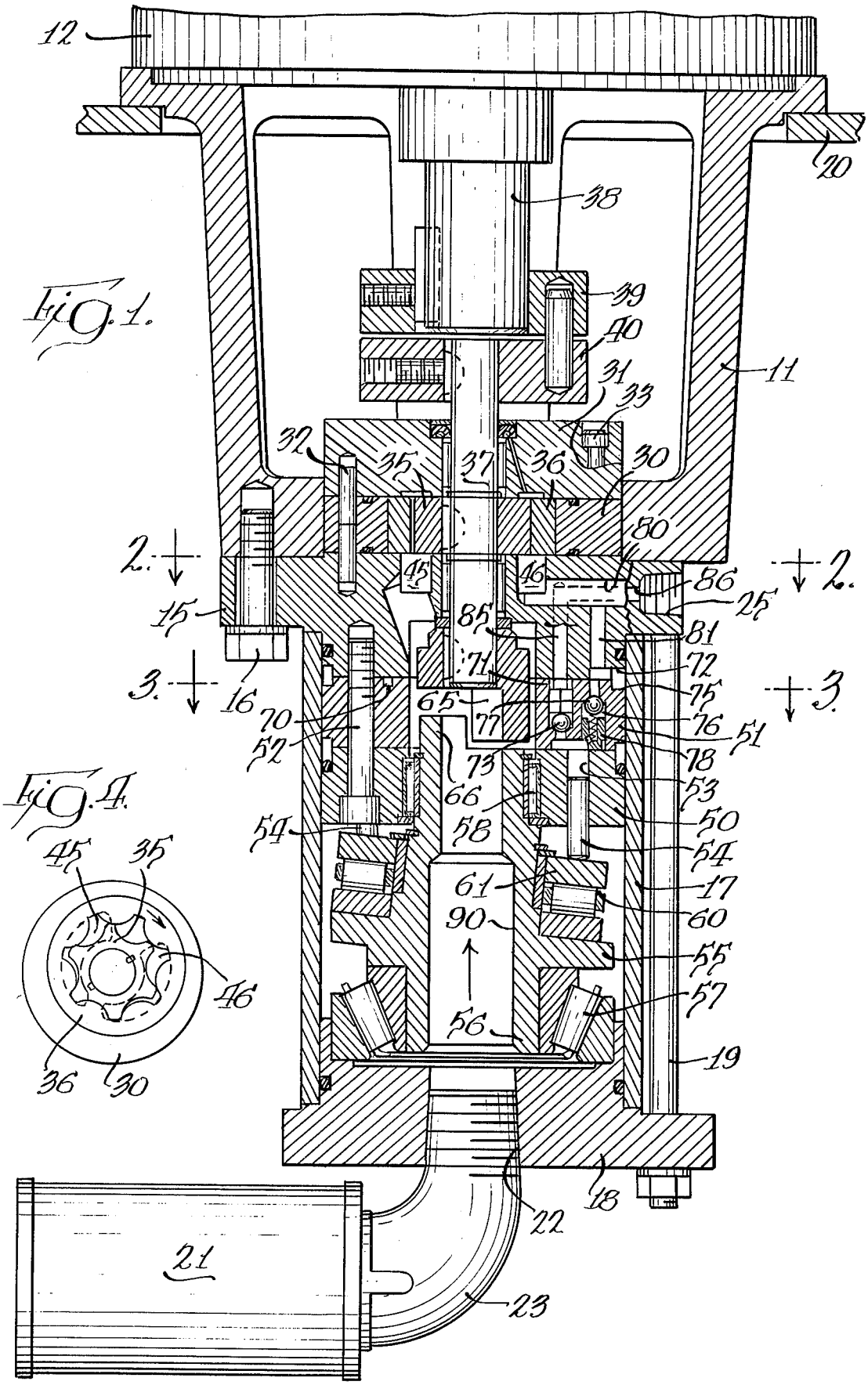
FIG. 1 is a central vertical section of the multistage pump.
FIG. 4 is a diagrammatic view of a multi-lobe pump of the type forming the low pressure stage of the two-stage pump.
Figure 2:
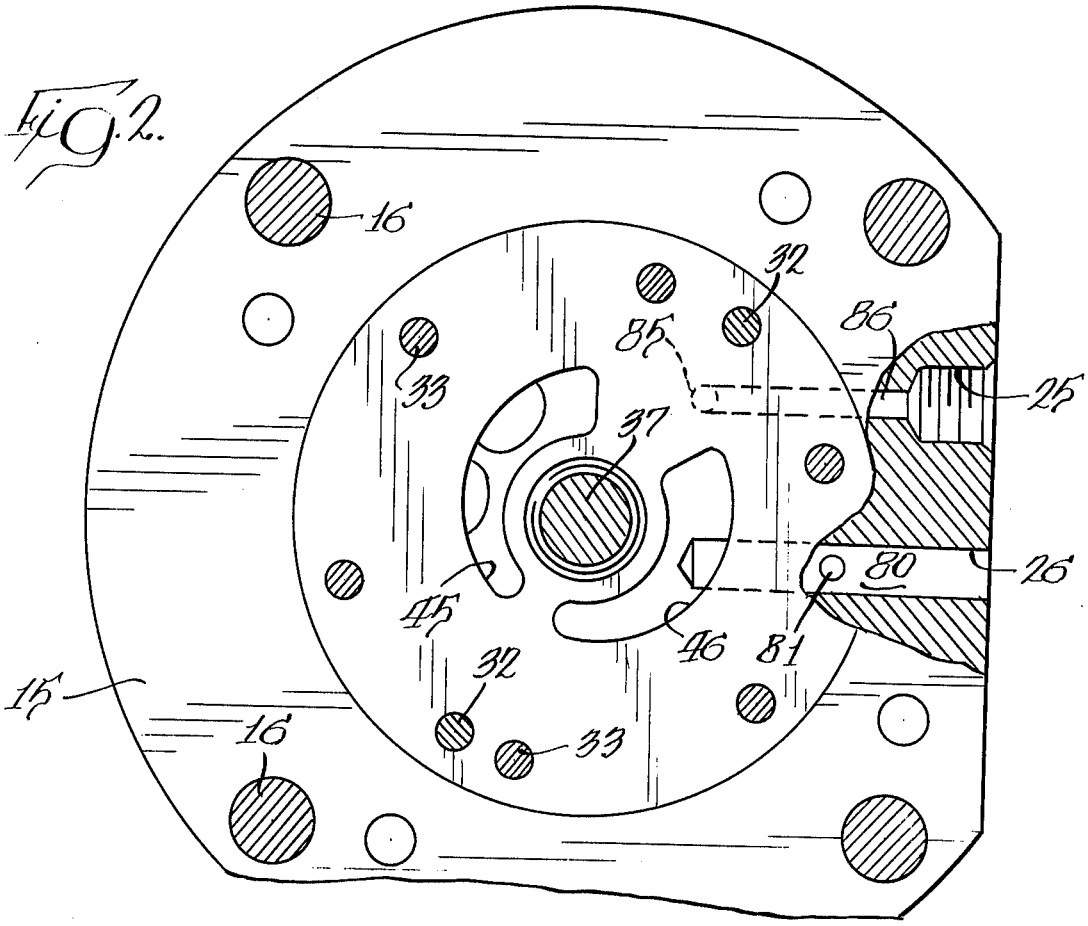
FIG. 2 is a plan section, on an enlarged scale, taken generally along the line 2—2 in FIG. 1.
Figure 3:
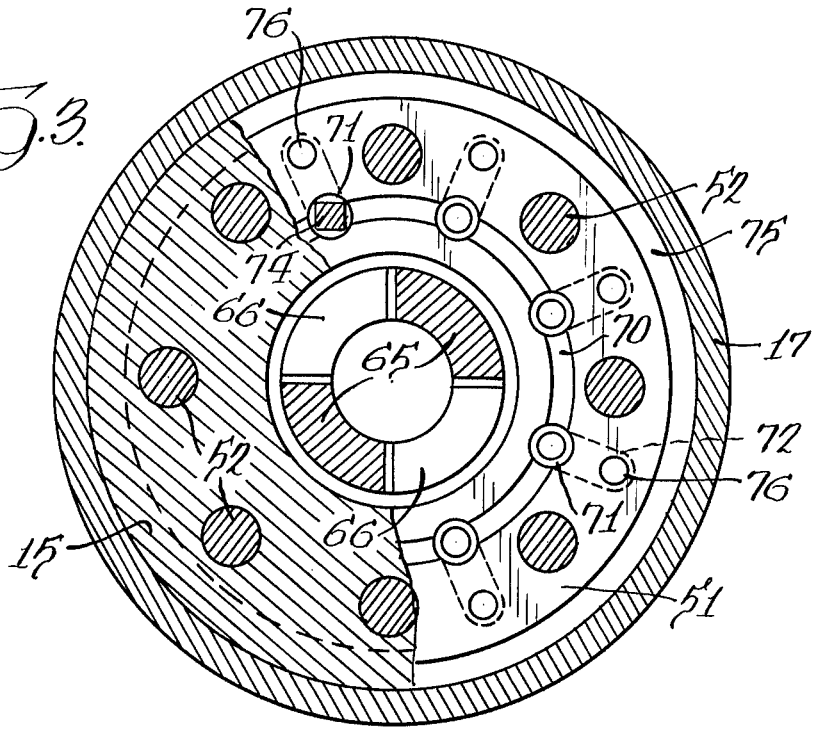
FIG. 3 is a plan section, on an enlarged scale, taken generally along the line 3—3 in FIG. 1.

The multi-stage pump has a casing with a section 11 mounting a drive motor 12 at one end thereof and a structural member in the form of a pump end plate 15 is fitted to the other end thereof and secured thereto by a series of fastening members 16. Additionally, the casing has a cylindrical sleeve 17 fitted onto a reduced diameter section of the pump end plate 15 and sealed thereto by an O-ring and with the opposite end of the sleeve being fitted onto an end plate 18 and sealed thereto by an O-ring. The end plate 18 and sleeve 17 are secured to the pump end plate 15 by a series of tie rods 19 extending around the sleeve 17 and threaded into the pump end plate 15.

The multi-stage pump, except for the drive motor 12, is mountable within a fluid reservoir having a top wall shown fragmentarily at 20 and with a filter 21 being positionable within the reservoir for supplying fluid to an inlet port 22 in the end plate 18 through a flow connection 23. Fluid delivered by the multi-stage pump is supplied to an unloading valve (not shown) by either of two fluid outlets from the casing, with there being a high pressure fluid outlet 25 and a low pressure fluid outlet 26 formed in the pump end plate 15. As well known in the art, it is the function of the unloading valve to permit a relatively large volume of fluid flow at low pressure from the multi-stage pump and, after a certain pressure is reached in the fluid supplied, the unloading valve functions to discontinue supply of fluid from the low pressure outlet port 26 with a resulting lesser flow of high pressure fluid from the high pressure outlet port 25.

A low pressure stage pump is a multi-lobe pump of the gerotor type and is contained within a ring-shaped housing 30 with the pump end plate 15 positioned to one side of the housing 30 and an end plate 31 positioned to the other side and with the three parts being aligned by means of alignment pins 32 and held in assembled relation by a series of fastening members 33 extended through the parts and threaded into the pump end plate 15. The multi-lobe pump has a rotatable inner member 35 with a series of external teeth and a rotatable outer member 36 with internal teeth. The inner member 35 is driven by drive means including the drive motor 12 and drive shaft means including a shaft 37 rotatably mounted by bearings in the end plate 31 and the pump end plate 15, with the drive shaft 37 keyed to the inner member 35. The drive shaft 37 is driven from the drive motor 12 by connections from drive motor output shaft 38 carrying an element 39 of a drive coupling and with another element 40 of the drive coupling connected to the coupling element 39 and secured to the drive shaft 37 whereby rotation of the drive motor output shaft 38 rotates the drive shaft 37.

The gerotor multi-lobe pump is well known in the art and is shown diagrammatically in FIG. 4. The inner member 35 has one less tooth than the outer member 36, with both of these members mounted on fixed centers, but eccentric to each other by shaping of a guide surface in the housing ring 30. As the members rotate clockwise, as viewed in FIG. 4, fluid is delivered from a fluid inlet 45 to the spaces between the teeth of the members and the fluid is carried around and discharged from a fluid outlet 46. The fluid inlet 45 and fluid outlet 46 are formed in the pump end plate 15, as shown in FIG. 1.

The high pressure stage pump is a piston pump and, particularly, an axial piston pump having a barrel 50 fitted against a valve head 51 which defines an additional structural member and with the barrel 50 and valve head 51 secured to the pump end plate 15 by a series of fastening members 52. The barrel 50 has an annular series of axially-extending cylinders 53, each of which has a reciprocable piston 54, with the strokes thereof being controlled by a rotatable angle plate 55. The angle plate 55 has a tubular section 56 which is rotatably mounted by means of a cone bearing 57 at one end thereof and a bearing 58 adjacent the other end and fitted within a central opening of the barrel 50. The angle plate carries a thrust bearing 60 including a bearing race 61 engageable with an exposed end of the pistons 54. During one revolution of the angle plate 55, the pistons 54 will be stroked between a retracted position, as shown for the piston at the right in FIG. 1, and an extended position for the piston shown at the left in FIG. 1.

The angle plate 55 is driven from the drive motor 12 and the drive shaft 37 by a coupling including a slotted coupling member 65 secured to the lower end of the drive shaft 37 and a slotted coupling formed at 66 on the upper end of the tubular section 56 of the angle plate.

The valve head 51 has an annular groove 70 on the upper face thereof forming a fluid outlet for the high stage pump and which communicates with an annular array of bores 71 extending through the valve head and at the lower end each communicating with an associated relately short radially-extending passage 72. Each of the bores 71 has a ball check 73 engageable against a valve seat and guided by a square-shaped cross section member 74 fitted in the bore which lets fluid flow thereby. A fluid inlet for the high stage pump is defined by an annular groove 75 which extends around the valve head 51 adjacent the inner wall of the sleeve 17 and communicates with an annular array of bores 76 by an undercut groove 77 on a face of the pump end plate 15. The lower end of each of the bores 76 communicates with a radial passage 72. Each of the bores 76 has a ball check valve 77 urged upwardly towards a valve seat in the bore by a spring-retainer structure 78 which is square-fitted in the bore 76 to permit flow therepast to the radial passage 72. With there being eight axially reciprocal pistons 54 in the barrel 50 and with this structure being mounted stationary in the casing, there are eight sets of bores 71 and 76, with one set being associated with each of the barrel cylinders 53.

The flow from the fluid outlet 46 of the low pressure stage pump is through a passage 80 leading to the outlet port 26 and the passage 80 has an intersecting passage 81 decending downwardly therefrom to communicate with the undercut groove 71 in the pump end plate and the annular groove 75 surround the valve head 51. With fuid being supplied under pressure by the low stage pump, it flows through the last-mentioned passages and past the check valves 77 into those barrel cylinders 53 which are moving from an extended position toward the retracted position, as shown at the right in FIG. 1. Those reciprocal pistons 54 which are moving from retracted to extended positions are pumping and directing fluid out through their associated check valves 73 and bores 71 to the annular groove 70 which communicates with a passage 85 in the pump end plate 15 which extends upwardly to communicate with a passage 86 leading to the high pressure fluid outlet port 25.

Fluid is supplied to the fluid inlet 45 of the low pressure stage pump by means including a flow passage 90 extending through the tubular section 56 of the angle plate and passage means defined by spaces between the drive coupling members 65 and 66 of the drive shaft 37 and angle plate 55, respectively, as well as through central openings in the valve head 51 and pump end plate 15.

In operation, the low pressure stage pump draws fluid from the reservoir through the filter 21 and through the flow passage within the high pressure stage pump to the fluid inlet thereof and directs low pressure fluid out of the outlet port 26 and to the high pressure stage pump bores 76. The delivery of fluid to the latter bores causes the pistons 54 to closely follow the bearing race 61 of the angle plate 55. The unloading valve (not shown) is made to exert sufficient back pressure to cause the flow to the fluid inlet of the high pressure stage pump and the fluid pumped by the high pressure stage flows to the unloading valve where it joins the flow from the low pressure stage pump. When there is a build-up in pressure in the unloading valve, as by a device being moved by the supplied fluid encountering increased resistance, the unloading valve acts to have fluid from the low pressure pump returned to reservoir, except for a sufficient build-up of back pressure to cause the output from the low pressure stage pump to supply the high pressure stage pump. The output of the high pressure stage pump then may be used in the system to provide only high pressure fluid.

With the construction disclosed herein, the casing may be positioned within the reservoir with a simple flow path from the reservoir to the fluid inlet of the low stage pump by means of a flow passage through the high stage pump.

I claim:

1. A two-stage pump having low and high pressure stages including a casing, a pair of pumps in said casing each having a rotatable pump element in coaxial relation, drive shaft means for rotating both of said pump elements, an outlet port from said casing, each of said pumps having a fluid inlet and a fluid outlet with the fluid outlet of one pump being in flow relation with said outlet port and the fluid inlet of the other pump, and means for supplying fluid to the fluid inlet of said one pump including a flow passage through the rotatable pump element of said other pump.

2. A two-stage pump as defined in claim 1 wherein said other pump is an axial piston pump with a stationary pump barrel having reciprocable pistons, and the rotatable pump element of said other pump is an angle plate which causes movement of said pistons during rotation thereof.

3. A two-stage pump as defined in claim 2 wherein said one pump is a multi-lobe unit having an inner member defining said rotatable pump element, structural members interconnecting said pumps, and passage means in said structural members interconnecting said flow passage to the fluid inlet of said one pump.

4. A two-stage pump as defined in claim 1 including a drive motor mounted at one end of said casing, and an inlet port at the opposite end of said casing in alignment with said flow passage through the rotatable pump element of said other pump.

5. A two-stage pump as defined in claim 1 wherein said one pump is a multi-lobe pump providing said low stage of operation with an inner member defining said rotatable pump element and said other pump is an axial piston pump having a stationary barrel with reciprocable pistons and said rotatable pump element of the axial piston pump is an angle plate for controlling movement of said pistons.

6. A two-stage pump as defined in claim 5 wherein said casing includes a sleeve housing said axial piston pump and with said barrel having a diameter approximately equal to the internal diameter of said sleeve.

7. A two-stage pump having a casing, a pair of pumps in the casing in coaxial relation including a multi-lobe pump defining a low pressure stage and having a rotatable inner member and a pump defining a high pressure stage having a barrel with reciprocable pumping elements and a control member for controlling movement of said pumping elements, one of said barrel and control member being rotatable coaxially with said inner member, means including a motor at one end of the casing and drive shaft elements for imparting rotation to said pumps, a fluid inlet at an end of the casing opposite said motor for supply of fluid to said casing, and means for supplying fluid to said multi-lobe pump from said fluid inlet including a flow passage through at least one of said barrel and control member of the piston pump.

8. A two-stage pump as defined in claim 7 wherein said high pressure stage pump is an axial piston unit, and said control member is an angle plate with a tubular section received within said barrel and said flow passage includes said tubular section.

9. A two-stage pump as defined in claim 8 wherein said barrel is stationary, structural members positioned between said multi-lobe pump and said barrel, said structural members having passages interconnecting a fluid outlet of the low pressure stage pump to a fluid inlet of the high pressure stage pump and additional passages connection said flow passage to a fluid inlet for the low pressure stage pump.

10. A two-stage pump as defined in claim 9 wherein said drive shaft elements extend into the passages of the structural members and include a coupling member, and said tubular section of the angle plate having an end in driving engagement with the coupling member and with space therebetween to permit fluid flow therethrough from said flow passage.

* * * * *